US006141932A

United States Patent [19]

Tarrant

[11] Patent Number: 6,141,932

[45] Date of Patent: Nov. 7, 2000

[54] METAL DECK ROOF CONSTRUCTION

[76] Inventor: Padraig M. Tarrant, 59 Brush Hill Rd., Kinnelon, N.J. 07405

[21] Appl. No.: 09/300,377

[22] Filed: Apr. 27, 1999

[51] Int. Cl.[7] ..... E04D 3/30

[52] U.S. Cl. ..... 52/514; 52/127.11; 52/202; 52/409; 52/783.11; 52/798.1; 52/749.12; 52/745.06; 52/783.14

[58] Field of Search ..... 52/514, 125.6, 52/126.6, 127.11, 90.2, 749.12, 745.06, 745.2, 783.11, 783.14, 798.1, 801.1, 409, 202, 506.06; 29/402.09, 402.14, 897.1

[56] References Cited

U.S. PATENT DOCUMENTS

| | | | |
|---|---|---|---|
| 3,320,704 | 5/1967 | Forsythe et al. . | |
| 3,759,006 | 9/1973 | Tamboise . | |
| 3,960,625 | 6/1976 | Simpson | 52/783.14 X |
| 3,978,630 | 9/1976 | Labie et al. . | |
| 3,981,109 | 9/1976 | Termohlen . | |
| 4,494,343 | 1/1985 | Berry et al. | 52/783.14 X |
| 4,520,610 | 6/1985 | Simpson et al. . | |
| 4,980,999 | 1/1991 | Terenzoni . | |
| 5,155,954 | 10/1992 | Roire . | |
| 5,274,967 | 1/1994 | Mladichek . | |
| 5,367,848 | 11/1994 | McConnohie | 52/336 |
| 5,660,004 | 8/1997 | Blackmon et al. . | |
| 5,720,147 | 2/1998 | Wenrick et al. . | |
| 5,724,781 | 3/1998 | Matthias . | |

FOREIGN PATENT DOCUMENTS 2 173 536 10/1986 United Kingdom .

*Primary Examiner*—Laura A. Callo
*Attorney, Agent, or Firm*—Richard C. Litman

[57] ABSTRACT

A metal deck roof repair module system that does not disturb the existing roofing membrane or insulation. The roof repair module has a surface profile similar to that of the existing deck, is installed from below the roof deck, and is jacked into mating position with the bottom surface of the existing roof deck. The repair module comprises two elongated frame angles pre-welded to a piece of corrugated sheet metal. The module is ultimately supported between two adjacent roof beams through support angles which frictionally engage the roof beam. A jacking lever comprised of a handle, an oval-shaped head, and a pin extending from a perimeter of the head, lifts the module to the existing deck by camming against a lower edge of the frame angle. A guide bolt extends through the frame angles and the support angles to prevent lateral movement of the module as it is raised.

6 Claims, 4 Drawing Sheets

METAL DECK ROOF CONSTRUCTION

BACKGROUND OF THE INVENTION

1. Field of the Invention

The present invention relates to roof reconstruction and in particular, a system for repairing metal roof decks.

2. Description of the Related Art

During its life time, the underside of a metal roof deck will be exposed to a variety of environments, e.g., humidity, condensation, chemical fumes, etc., which will cause the deck to deteriorate. In many cases, the deck will no longer be adequate to support the roofing materials, and/or live loads such as roof machinery, foot traffic, snow loads, etc. The end result in such cases is often a collapse of the roof deck, unless remedial work is performed. The traditional form of remedial work involves removal and replacement of the metal deck, the roofing membrane and insulation, even if the roofing membrane and insulation are in good condition. This procedure, needless to say, is very costly due to the demolition, removal, and replacement of existing roofing materials. Thus, there exist a need for a new way to repair sections of metal roof deck other than disturbing the roofing envelope above the roof deck and replacing what might otherwise be properly functioning components of the roofing system. More specifically, there exists a need to find a way to repair, from below the deck, sections of a deteriorated (existing) metal deck, but in a manner that will result in a structurally sound roof deck.

U.S. Pat. No. 5,724,781 issued to Matthias et al on Mar. 10, 1998 concerns a method for raising foundations of building structures. Matthias does not suggest the present method as claimed. U.S. Pat. No. 5,155,954 issued to Roire on Oct. 20, 1992 concerns a device for temporary retention of a lifting element on a metal surface. Roire does not suggest the present device as claimed. U.S. Pat. No. 4,980,999 issued to Terenzoni on Jan. 1, 1991 concerns a system for raising a roof. Terenzoni does not suggest the present method as claimed. U.S. Pat. No. 3,320,704 issued to Forsythe et al is a roof deck and method of construction. Forsythe et al does not suggest the present method as claimed. U.S. Pat. No. 3,759,006 issued to Tamboise is a metallic framework and floor resulting therefrom. Tamboise does not suggest the present method as claimed. U.S. Pat. No. 3,978,630 issued to Labie et al discloses ground constructed, hoisted, and supported floors. Labie et al does not suggest the present device as claimed. U.S. Pat. No. 3,981,109 issued to Termohlen discloses a process and apparatus for supporting hoisted floors. Termohlen does not suggest the present method or device as claimed. U.S. Pat. No. 4,520,610 issued to Simpson et al discloses a method for installing a roof system over an existing roof structure. Simpson et al does not suggest the present method or device as claimed. U.S. Pat. No. 5,274,967 issued to Mladichek discloses a roof assembly. Mladicheck does not suggest the present method or assembly as claimed. U.S. Pat. No. 5,720,147 issued to Wenrich et al discloses a method of insulating metal deck roof structures. Wenrich et al does not suggest the present method or assembly as claimed. Finally, U.K. Application 2 173 536 A issued to Jackson discloses a method for repairing a building, but Jackson does not disclose the method of the present invention as claimed.

None of the above inventions and patents, taken either singularly, or in combination, is seen to describe the instant invention as claimed. Thus, a metal deck roof construction solving the aforementioned problems is desired.

SUMMARY OF THE INVENTION

The invention relates to roofing reconstruction, and in particular, metal roof deck reconstruction. The traditional method of repairing a corrugated metal roof deck involves removal and replacement of the metal deck, as well as removal and replacement of the overlying roof membrane and insulation, even if they are in good condition. This procedure is costly due to the demolition, removal, and replacement of existing materials so there exists a need for a way to repair sections of corrugated metal roof deck in a manner that will not disturb the roof envelope (above the roof deck). The present invention solves this problem. The present invention involves supporting, from below, the deteriorated existing metal deck, with a new deck segment having a surface profile similar to that of the existing deck.

The new deck segment, or module, comprises a piece of sheet metal and two elongated frame angles. Each frame angle has a predrilled guide hole flanked by a final lock hole on either side of the guide hole. The frame angle is pre-welded to, and along opposite ends of, a substantially flat, rectangular, piece of corrugated sheet metal. The new deck module is installed from below the existing deck, and is supported between two adjacent I-beams, or other type of roof beam, e.g. concrete, using four support angles, two for each I-beam. The horizontal leg of each support angle is inserted between the raised flutes of the existing deck to rest upon the top surface of the I-beam, while the vertical leg, extending downward, has a-vertical, centrally disposed guide slot flanked on either side by two columns of bolt holes.

A pivoting jack, shaped like a flattened golf club, and comprised of a handle, an oval-shaped head, and a pin extending from a perimeter of the head, is used to jack up the new deck segment into mating alignment with the existing deck. The pin on the jack head is inserted into the base of the guide slot. As the jack handle is rotated about the pin, the jack head rolls or "cams" against a lower edge of the deck support angle. A guide bolt extends through the guide hole of the deck support angle and is loosely locked with a nut at the back of the guide slot. The guide bolt prevents lateral movement of the new deck segment as it is raised into engagement with the existing deck. When the deck segment can be raised no further, the frame angle is bolted to the support angle using a locking nut. At that point, the guide bolt may be removed.

Since the frame angles are pre-welded to the new deck segment, there is no welding at the site, and thus no need for a skilled work force. According to this invention, there is no need to fire protect anything, ie., no fire system, no smoke system, and no venting is required since there are no welding fumes. The invention will extend the safe operating life of the roofing deck, while eliminating the need to remove and replace the roofing membrane and insulation.

Accordingly, it is a principal object of the invention to provide a method for quickly and conveniently repairing a deteriorated metal roof deck.

It is another object of the invention to provide a method for repairing a deteriorated metal roof deck without having to remove or replace the existing roofing membrane or insulation.

It is a further object of the invention to repair a metal roof deck without the need for welding tools or skilled labor.

Still a further object of the invention is to provide a deck system and a lever jack for assembling the deck system to serve the above purposes.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
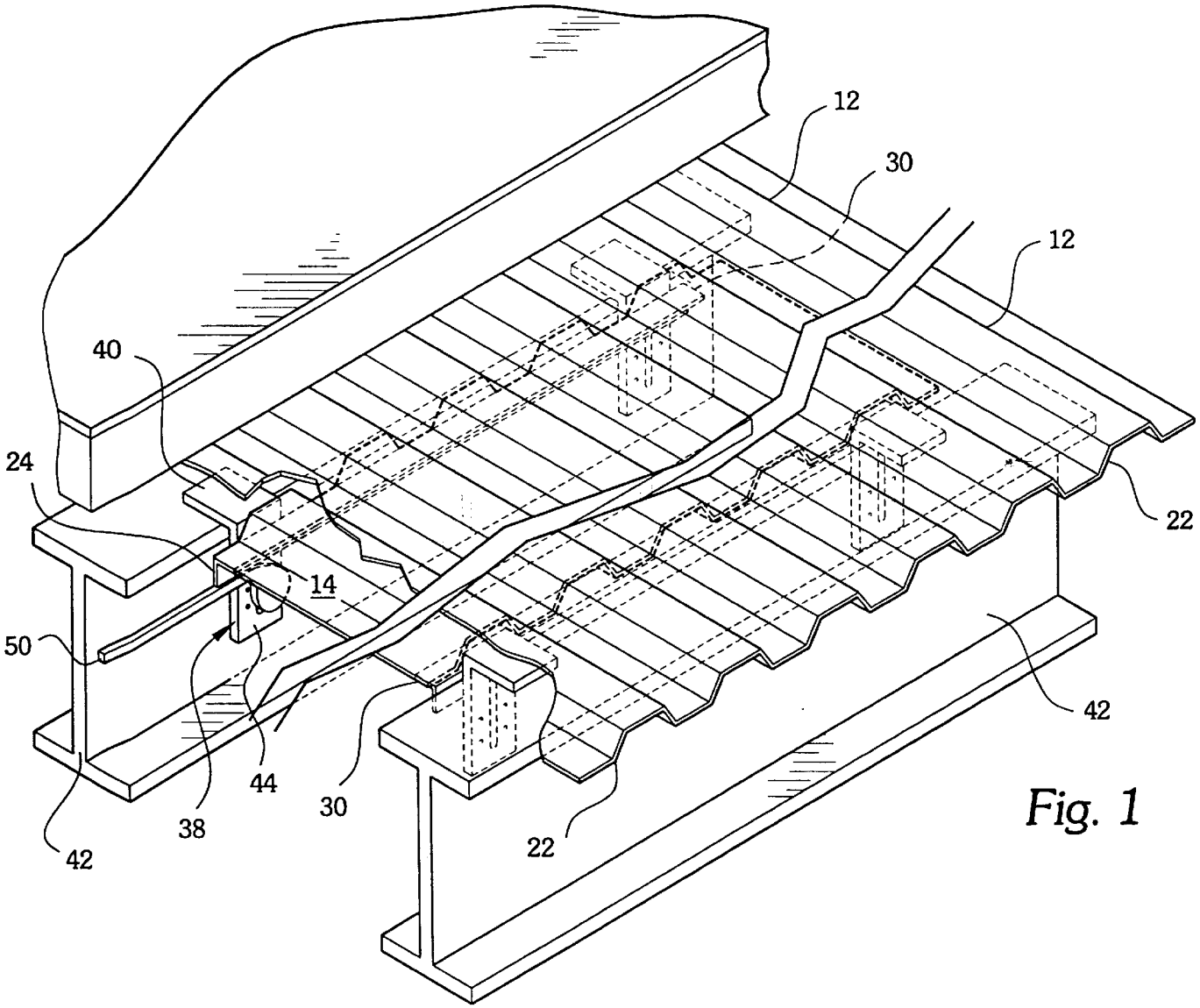
FIG. 1 is a perspective view, with a cut away of an existing roofing system, showing application of a roof repair module according to the present invention.
Figure 2A:
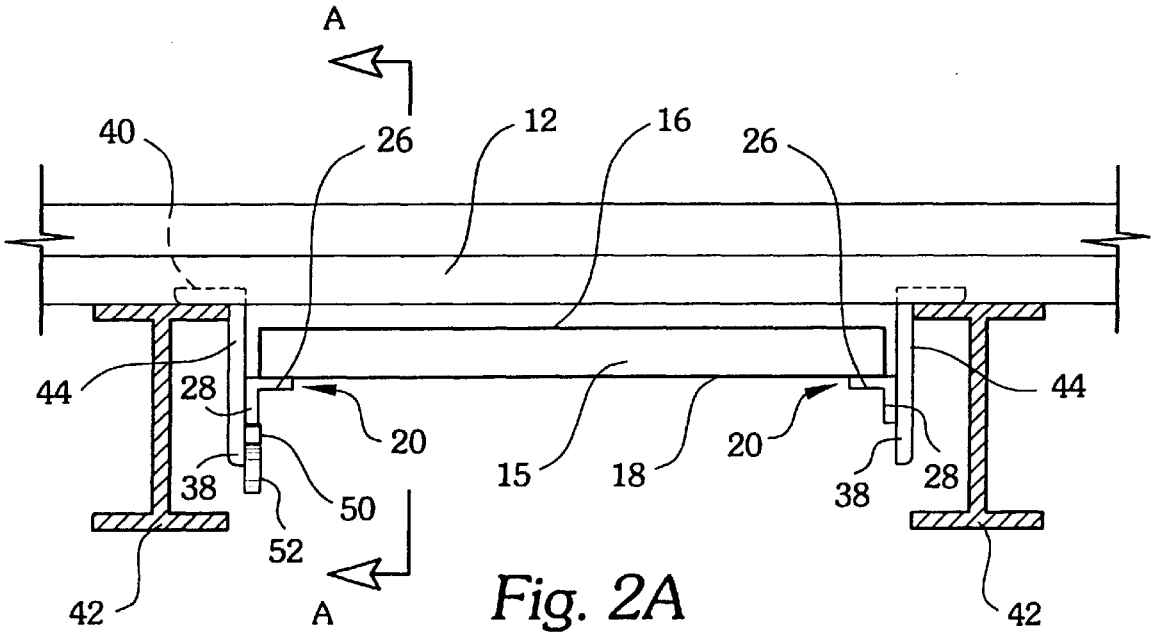
FIGS. 2A–2B are sections through I-beams of the roof deck, showing a new deck member in pre-installed and installed positions.
Figure 2B:
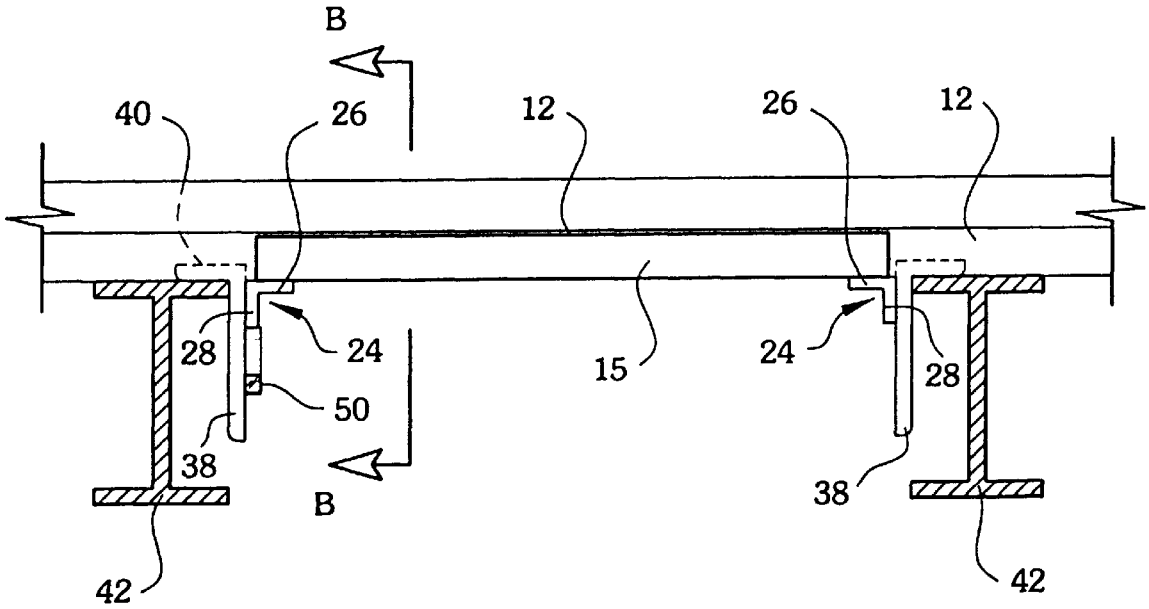

The present invention, as best shown in FIG. 1, is a modular system, and a method for repairing a metal roof deck. An existing roof deck 12 can be repaired using a repair module 14 comprising a substantially rectangular corrugated metal sheet 15 having a top surface 16, a bottom surface 18 wherein surface 18 has two end edges 20, and a plurality of flutes 22 connecting end edges 20, and extending along a major axis of the metal sheet. As shown in FIGS. 2A and 2B, frame angle 24 is pre-welded along each of end edges 20. Frame angle 24 further comprises a long horizontal component 26 welded to, and masking, an edge 20. A shallow vertical component 28 having two ends 30, and a plurality of frame angle holes 32 proximate each of two ends 30. Preferably, there are three frame angle holes at each of two ends 30. This includes guide hole 34 in the center, flanked by two final lock holes 36.

Figure 3A:
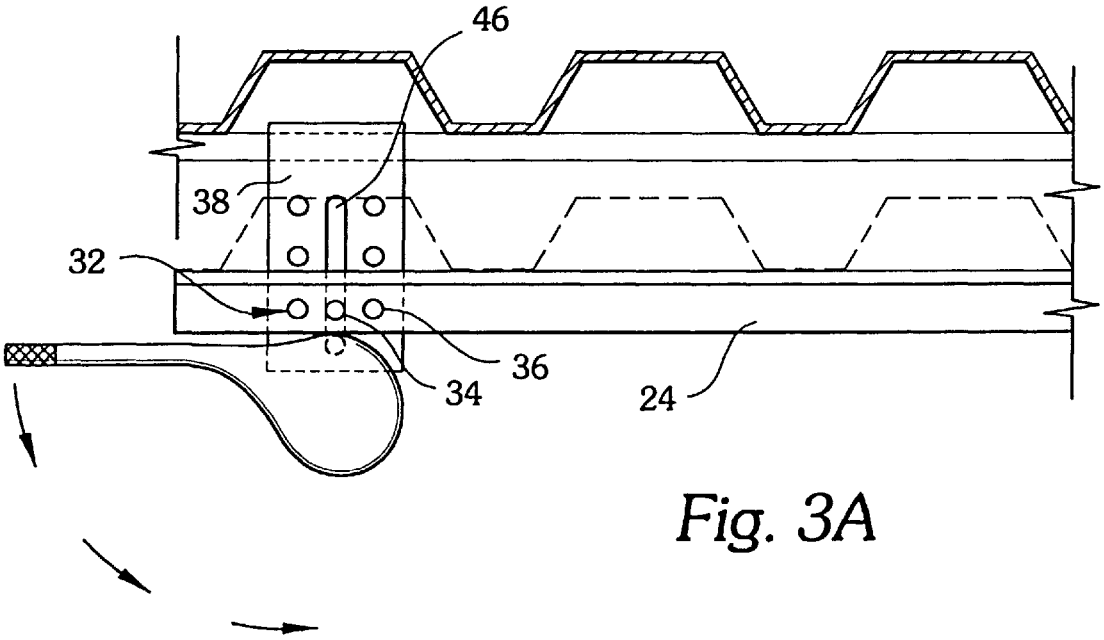
FIGS. 3A–3B are sections along I-beams beneath a roofing system before and after a new deck segment is raised by the lever jack.
Figure 3B:
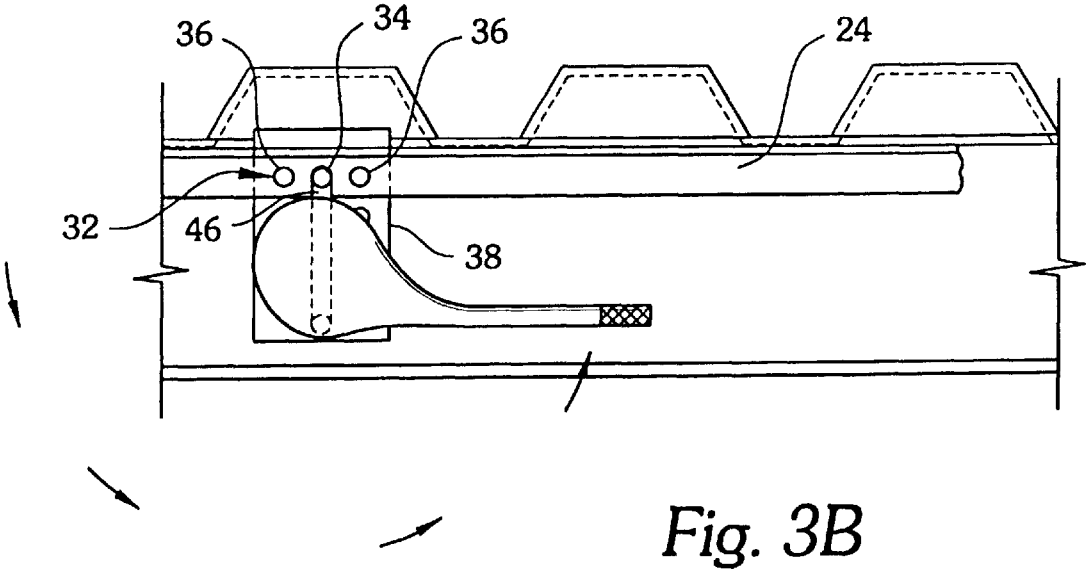

As best shown in FIGS. 2 and 3, the module described above is supported by a module support angle 38, which comprises a horizontal leg 40 frictionally attached to a surface of a roof support beam 42. Horizontal leg 40 is disposed between adjacent flutes 22 of metal deck 12. A vertical leg 44 extends downward from horizontal leg 40. Vertical leg 44 has a vertical guide slot 46 and at least three rows of support angle holes, each of said rows running perpendicular to guide slot 46. A loosely locking guide bolt extending through guide hole 34 slidingly engages guide slot 46. In the preferred embodiment, two holes on each row of support angle holes is capable of aligning with the row of frame angle holes 32.

Figure 4:
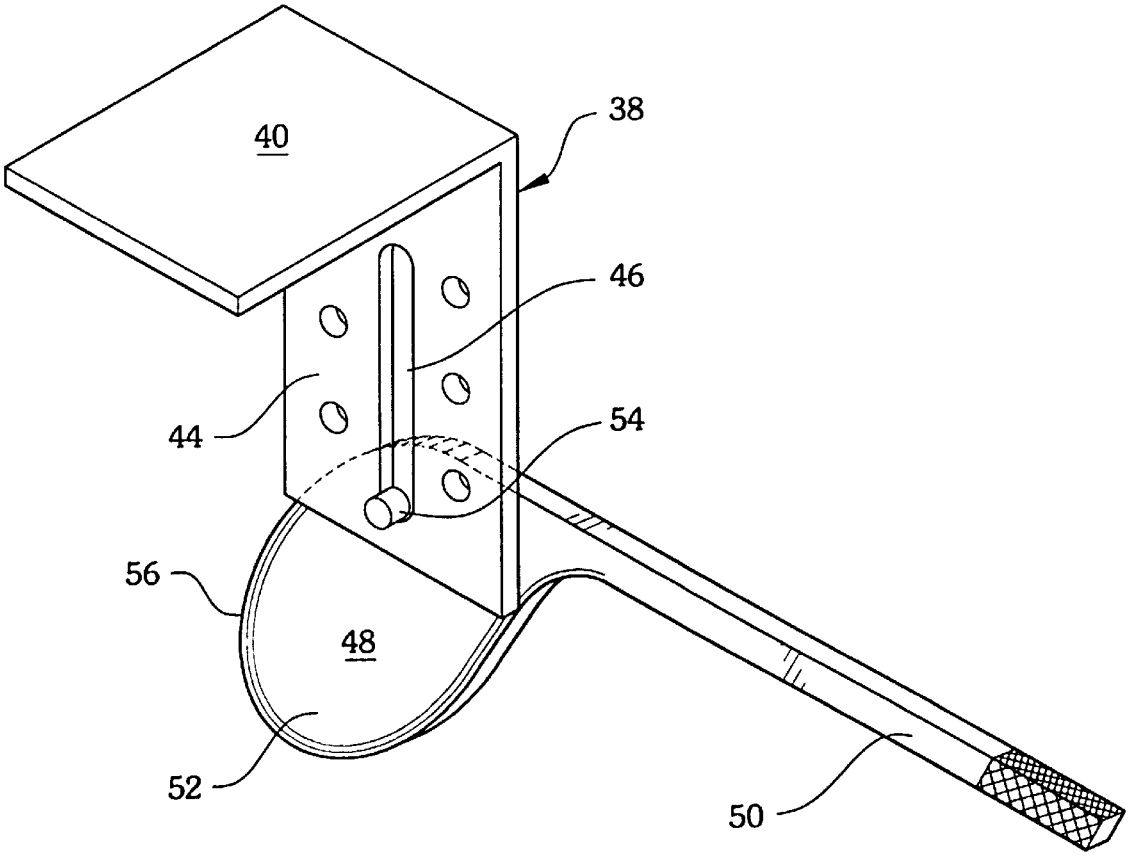
FIG. 4 is a perspective view of the lever in relation to an end support angle.

As best shown in FIG. 4, the preferred jacking lever 48 is metal and appears as a flattened golf club, having a handle 50, an oval-shaped head 52 attached to handle 50. In the preferred embodiment, head 52 has two planar surfaces, one adjacent leg 44 of support angle 38, and one opposite support angle 38. Lever 48 could have merely one planar surface, but that one planar surface must face support angle 38. Pin 54 is fixedly attached to, and extends from, a perimeter 56. Pin 54 in insertable into the base of guide slot 46, and it maintains rotational engagement with said slot 46. In operation, handle 50 rotates about the base. Head 52 of jacking lever 48 maintains camming engagement with repair module 14 and frame angle 24.

The preferred method of using the modular system for repairing a deteriorated metal roof deck 12 begins when the contractor surveys the site to determine the height of flutes 22, and the distancing between roof beams 42. This enables the contractor to determine the distance between the rows of holes on vertical leg 44, and on vertical component 38, as well as the length of his repair module 14, respectively. The length of repair module 14 is slightly less than whatever distance there is between two adjacent roof beams. The phrase "slightly less" as used herein, is defined as about two times the thickness of vertical leg 44. The distance between the rows of holes is a function of the height of the flutes on the metal deck, the size of head 52 of jacking lever 48, and the row on leg 44 selected for initial attachment of frame angle 24 of repair module 14.

After fabricating repair module 14 and support angle 38 off site, the contractor installs four support angles, two upon each of two adjacent roof beams, by inserting a horizontal leg 40 of support angle 38 between the raised flutes of an existing metal roof deck 12 such that the horizontal legs rest upon roof beam 42. No fasteners are needed to attach the support angle to the beam because the support angles are subjected to forces in multiple directions due to the fact that it is sandwiched between the existing metal deck and a top surface of the roof beam, and between the module, in its final, locked position and an upper edge of the roof beam. Next the contractor manually lifts the repair module from below an existing metal roof deck, towards the undersurface of the existing deck. The contractor then loosely locks a guide bolt through guide hole 34 on each end of each frame angle 24. The guide bolt slidingly engages guide slot 46. Next, the contractor hand-pivots jacking lever 48 to raise a corner of repair module 14 into mating engagement with a bottom surface of existing metal deck 12. The contractor then uses two locking bolts to penetrate an upper row of holes in vertical leg 44 and through matching holes 36 of vertical component 28. A locking nut is then employed on a back side of slot 46 to complete the lock. This is repeated at each of four corners of repair module 14. Finally, each of four guide bolts are removed, one from each support angle 38, and the job is done.

It is to be understood that the present invention is not limited to the embodiments described above, but encompasses any and all embodiments within the scope of the following claims.

I claim:

1. A metal roof deck repair module, comprising:

a substantially rectangular corrugated metal sheet having a length equal to about two adjacent roof beams, comprising:

a top surface;

a bottom surface having two end edges;

a plurality of flutes connecting said two end edges and extending along a major axis of said sheet; and a frame angle welded along each of said two end edges, wherein said frame angle further comprises:

a long horizontal component welded to, and masking, said end edge; and a shallow vertical component having two ends, and a plurality of frame angle holes along each of said two ends.

2. The metal roof deck repair module according to claim 1, wherein the number of said holes is at least three.

3. The metal roof deck repair module according to claim 1, further comprising:

a support angle comprising:

a horizontal leg frictionally attached to a surface of a roof beam, said leg disposed between adjacent flutes of an existing metal deck;

a vertical leg extending downward from said horizontal leg, said vertical leg having a vertical guide slot and at least three rows of support angle holes, each of said rows running perpendicular to said guide slot;

a loosely locking guide bolt extending through one of said frame angle holes to slidingly engage said guide slot;

wherein said plurality of frame angle holes are arranged in a row and wherein each of said rows of said support angle holes is capable of aligning with said row of frame angle holes, and at least one of said frame angle holes aligns with said guide slot so as to receive said guide bolt.

4. The metal roof deck repair module according to claim 3, further comprising:

a handle, an oval-shaped head attached to said handle, said head having at least one planar surface;

a pin fixedly attached to, and extending from, a perimeter of said planar surface of said head, said pin insertable into said guide slot;

wherein, said perimeter of said head maintains camming engagement with said frame angle, said planar surface of said head maintains sliding engagement with said support angle, and said pin maintains rotational engagement with said guide slot.

5. A roof deck repair system, comprising:

a roof deck repair module comprising:

a substantially rectangular corrugated metal sheet comprising:

a top surface;

a bottom surface having two end edges; and a plurality of flutes connecting said two end edges and extending along a major axis of said sheet;

a frame angle welded along each of said two end edges, wherein said frame angle further comprises:

a long horizontal component welded to, and masking, said end edge; and a shallow vertical component having two ends, and a plurality of frame angle holes arranged in row along each of said two ends; and a module support angle comprising:

a horizontal leg frictionally attached to a surface of a roof support beam, said horizontal leg disposed between adjacent flutes of an existing metal deck;

a vertical leg extending downward from said horizontal leg, said vertical leg having a vertical guide slot and at least three rows of support angle holes, each of said rows running perpendicular to said guide slot; and a loosely locking guide bolt extending through one of said frame angle holes to slidingly engage said guide slot;

wherein each of said rows of said support angle holes is capable of aligning with said row of frame angle holes, and at least one of said frame angle holes aligns with said guide slot to receive said guide bolt;

a jacking lever comprising:

a handle, an oval-shaped head attached to said handle, said head having at least one planar surface; and a pin fixedly attached to, and extending from, a perimeter of said planar surface of said head, said pin insertable into a base of said guide slot;

wherein, said head of said jacking lever maintains camming engagement with said repair module, and said planar surface of said head maintains sliding engagement with said support angle, and said pin maintains rotational engagement with said guide slot.

6. A method for repairing a deteriorated metal roof deck using a roof deck repair module, support angles, and a jacking lever, comprising:

placing two support angles upon each of two adjacent roof beams by inserting horizontal legs of the support angles between the raised flutes of an existing metal roof deck;

manually lifting the repair module from below the existing metal roof deck, wherein the length of the module is approximately equal to the distance between the two adjacent roof beams;

loosely locking a guide bolt through a guide hole of each of two ends of each of two frame angles of the repair module, with the bolt slidably engaging a support angle slot;

hand-pivoting a jacking lever to raise a corner of the repair module into mating engagement with a bottom surface of the existing metal deck;

bolting with a locking nut the corner of the repair module to one of the two support angles;

repeating the steps of hand-pivoting and bolting at each of four corners of the repair module; and removing each of the guide bolts.

* * * * *